United States Patent [19]

Straujups

[11] 3,972,486

[45] Aug. 3, 1976

[54] WINDING APPARATUS WITH ROLL TRANSFER MEANS AND METHOD

[75] Inventor: John E. Straujups, Lexington, Mass.

[73] Assignee: Birch Brothers Southern, Inc., Waxhaw, N.C.

[22] Filed: Aug. 1, 1974

[21] Appl. No.: 493,847

[52] U.S. Cl. ..... 242/66; 242/55.1

[51] Int. Cl.[2] ..... B65H 17/12; B65H 19/28

[58] Field of Search ..... 242/66, 55.1, 56 R

[56] References Cited

UNITED STATES PATENTS

| | | | |
|---|---|---|---|
| 2,676,764 | 4/1954 | Aulen | 242/66 X |
| 2,682,379 | 6/1954 | Piper et al. | 242/66 X |
| 2,989,262 | 6/1961 | Hornbostel | 242/66 X |
| 3,066,883 | 12/1962 | Egan | 242/66 X |
| 3,614,010 | 10/1971 | Aulen | 242/66 X |

*Primary Examiner*—George F. Mautz

*Attorney, Agent, or Firm*—Bell, Seltzer, Park & Gibson

[57] ABSTRACT

A winding apparatus and method in which a roll of web material is supported at a first winding position during winding to a predetermined initial size and at a second winding position during continuation of winding to a final size, the apparatus having mechanism for feeding winding cores along a predetermined path of travel to the first winding position and a pair of transfer arms which move along a path intersecting the path of travel of winding cores fed to the first winding position for engaging a winding core of a roll of web material in the first winding position and displacing the roll to the second winding position, with the movement of winding cores and the pair of transfer arms occuring in sequential timed relation so as to avoid interference therebetween.

9 Claims, 10 Drawing Figures

Fig-10
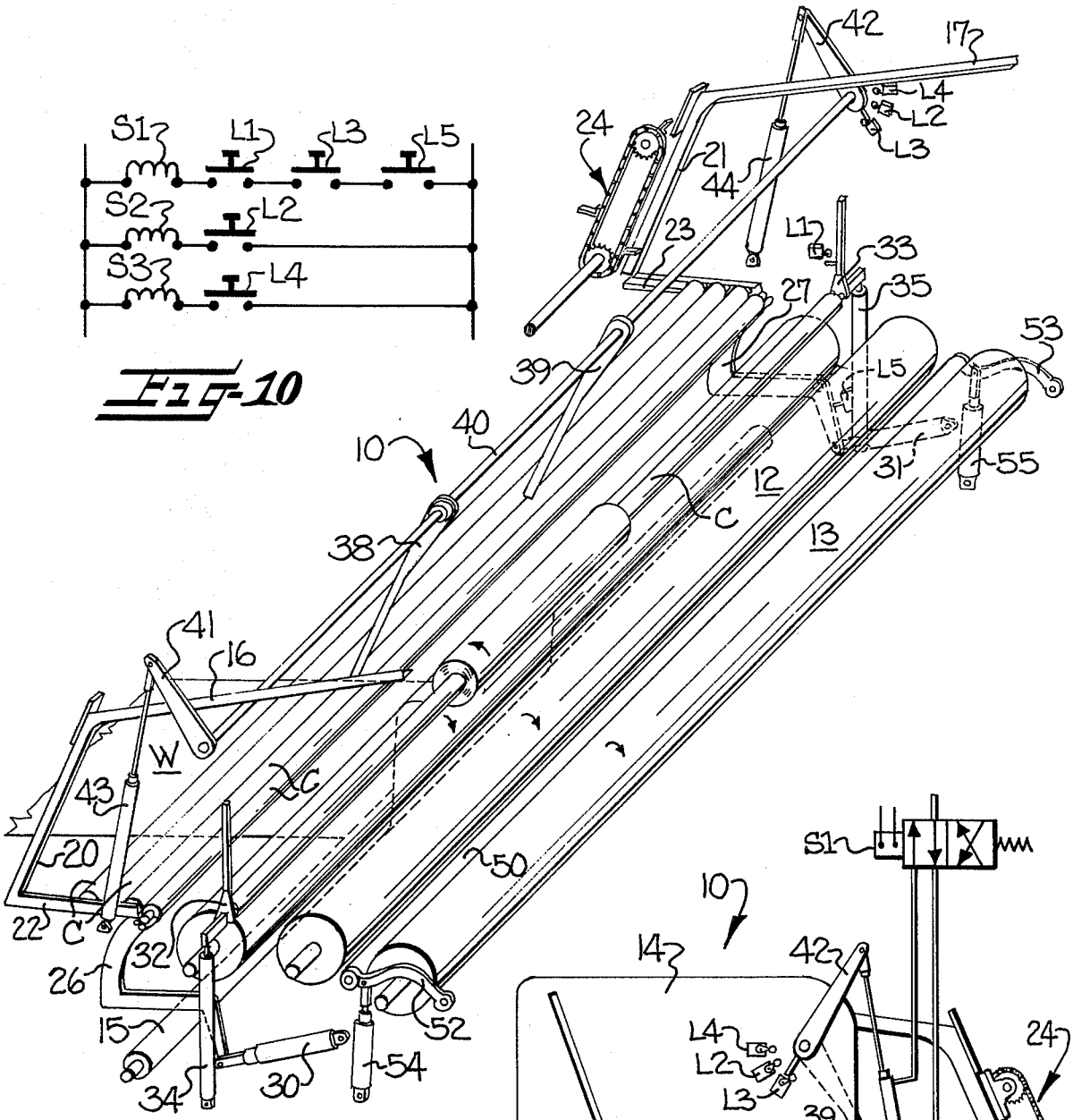
Fig-3
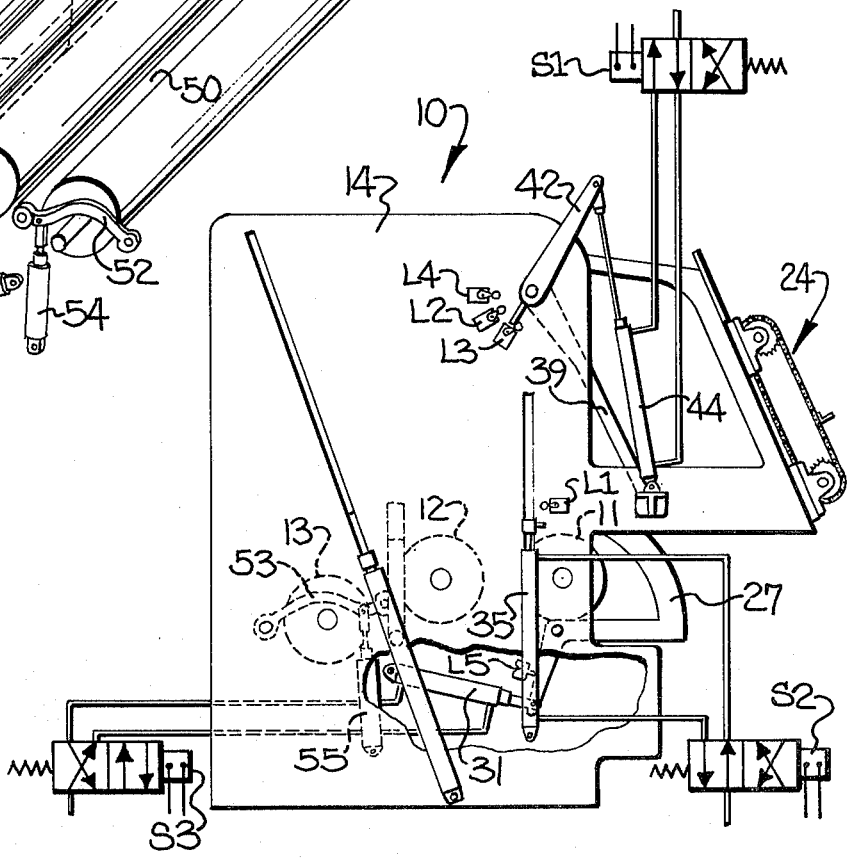
Fig-2

WINDING APPARATUS WITH ROLL TRANSFER MEANS AND METHOD

It has heretofore been proposed to wind web materials of various types into rolls by using apparatus which supports a winding core at a first winding position for initiation of winding of web material thereabout and during winding of a roll of web material to a predetermined initial size and then supports the roll of web material at a second winding position during continuation of winding to a final size. Such apparatus, particularly as exemplified by U.S. Pat. Nos. 3,167,268; 3,049,311 and 3,047,248 owned in common with the present invention, have achieved significant success in handling web materials ranging from thin low density foam products to heavy and stiff floor covering materials. In such applications, one significant advantage is the ability to "batch" or form a successive plurality of rolls of web material from an essentially continuous supply of such material to the winder.

In accomplishing such formation of successive rolls, problems have been presented wherein the web material has a width substantially less than the length of the elongate core that it is being wound upon. Attempts to transfer such a roll of web material from the first winding position to the second winding position by a transfer force applied on the extreme opposite ends of the elongate core as in the prior art cause flexure of the core. Such flexure results in a snapping or jerking transfer movement of the roll, introducing unacceptable wrinkles or folds into the web material, and, in extreme instances, may interrupt winding by dislocating the roll or breaking the winding core.

In order to achieve highly productive operation of the type of winding apparatus that this invention is concerned with, it is desirable to have a magazine for containing a series of successive cores and means associated with the magazine for receiving the cores and successively feeding the same to the first winding position. Also it is desirable to have transfer means for quickly transferring the initial size roll of web material from the first winding position to the second winding position. While the aforementioned prior patents disclose winding machines of the type herein described having the foregoing features for readily accommodating the winding of rolls of material having a width substantially corresponding to the length of the cores, they are not effective in winding rolls of material wherein the width of the material is substantially less than the length of the core. It has now been determined that, in order to achieve a smooth transfer of such lesser width rolls of material from the first to the second winding position and avoid flexure of the cores and the problems attendant thereto, the lesser width roll of web material needs to be transferred by engagement of the transfer means closely adjacent opposite ends of the roll of material, while on the other hand, successive cores are more uniformly fed to the first winding position by engaging the cores adjacent their opposite end portions.

In view of the recognized prior arrangements and the deficiencies and difficulties which have been pointed out, it is an object of this invention to achieve independent and non-interfering movement in delivering a winding core for formation of a roll of web material and in transferring a roll being wound between successive winding positions. In realizing this object of the invention, transfer arms for engaging a winding core of a roll of web material in a first winding position and for displacing the roll to a second winding position are movable along a path intersecting a path on which winding cores travel in being fed to the first winding position. By means of a control operatively connecting the transfer arms and the mechanism for delivering cores, the two mechanisms operate in a desired, non-interfering sequential timed relation.

Yet a further object of this invention is to accommodate the winding of web material having a width substantially less than the length of the winding core about which the web material is formed into a roll. In realizing this object of the present invention, transfer forces moving the roll between first and second winding positions are applied by positioning of transfer arms immediately adjacent the ends of a roll of web material so as to avoid flexure of the winding core.

Some of the objects of the invention having been stated, other objects will appear as the description proceeds, when taken in connection with the accompanying drawings, in which —

FIG. 2 is a reduced scale external side elevation view of the apparatus of FIG. 1, taken from a direction of view opposite the direction of that Figure;

FIG. 3 is a perspective view of portions of the winding apparatus of FIG. 1, illustrating the construction and operation of this invention;

FIG. 10 is a schematic control diagram.

While this invention will be described hereinafter with more particular reference to the accompanying drawings, illustrating the best mode for practice of this invention contemplated at the time this description is prepared, it is to be understood at the outset that this invention is considered as having utility beyond the specific apparatus shown and method described. Accordingly, it is intended that the specific description of the best mode presently contemplated be understood as a broad and general teaching of this invention which will enable persons skilled in the art of winding apparatus to apply this invention more generally. For this reason, the drawings and description are to be taken broadly rather than as being restrictive upon the apparatus and method of this invention.

Figure 1:
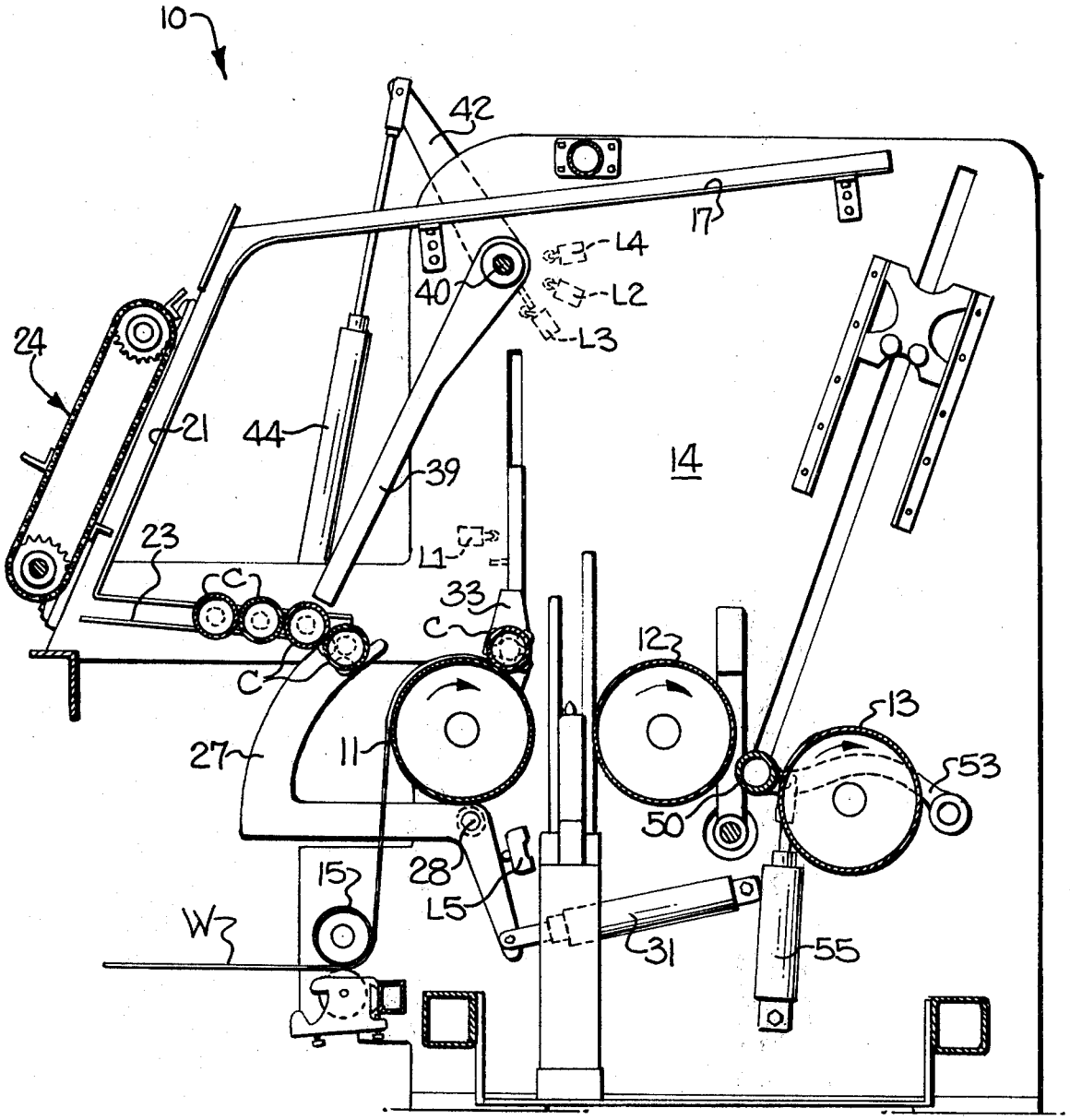
FIG. 1 is a side elevation view, partially in section, through a winding apparatus constructed and operated in accordance with this invention.

The winding apparatus of this invention, generally indicated at 10, includes a plurality of elongate driving rolls 11, 12, 13 mounted for rotation about parallel spaced apart axes. As is known to persons familiar with the aforementioned related prior patents, the driving rolls extend between a pair of spaced apart upstanding end frames, one of which is shown in FIG. 1 as end frame 14. In operation of the apparatus 10, one driving roll 11 supports a roll of web material at a first winding position during winding of the roll to a predetermined initial size. Thereafter, the roll is supported at a second winding position by other driving rolls 12, 13 during continuation of winding to a final size. Many of the details of construction and operation of such apparatus are made clear in the prior patents and accordingly will not be repeated at length here. Instead, the disclosures of those patents are incorporated by reference, to any extent deemed necessary for understanding this invention, and interested readers are directed to those patents.

In order to guide web material W to be wound by the apparatus 10, an entry guide roller 15 is mounted between the end frames. Web material W is guided along a predetermined path of travel to the driving rolls 11, 12, 13 and is trained over those rolls for winding.

Mandrels or winding cores C about which web material W is wound into rolls, are supplied by a core feeding means including magazine means for receiving and supplying a plurality of cores C. In the form illustrated, the magazine means includes guide members mounted on the spaced apart upstanding end frames for defining spaced apart upper trackways 16, 17, which receive opposite terminal end portions of the cores C. When placed on the trackways 16, 17 the cores C roll toward one side of the winding apparatus 10 and pass down vertically extending trackway portions 20, 21 to generally horizontally extending portions 22, 23 in which a plurality of cores are retained in readiness for successive positioning for winding (FIGS. 1 and 2). While passing down the vertically extending trackway portions, the cores are restrained against free fall by a braked chain arrangement indicated generally at 24.

Positioned adjacent the lower trackways 22, 23 are a pair of load arms 26, 27 each mounted for pivotal movement about a common pivot axis 28. The two arms 26, 27 are moved by portions of a control means including a pair of pressure fluid actuated cylinder devices 30, 31. Each of the cylinder devices 30, 31 has a cylinder and a piston extensible from the cylinder on admission of actuating pressure fluid to the cylinder, with one of the cylinder and piston being pivotally connected to the corresponding end frame of the winding apparatus 10 and the other of the cylinder and piston being pivotally connected with the corresponding arms 26, 27. By coordinated admission of actuating pressure fluid to the cylinder devices 30, 31, the arms 26, 27 are intermittently operated for feeding winding cores C along a predetermined path of travel from the horizontal trackways 22, 23 of the magazine means to a first winding position.

While winding apparatus in accordance with this invention have been constructed to accept winding cores of substantial length, on the order of 200 inches or more, such apparatus are frequently employed for winding rolls of web material having a width substantially less than the length of the winding cores used, such as on the order of 54 inches. The winding of such material is indicated in FIG. 2, where the roll of web material W will be noted as being wound in a medial portion of the core C which is disposed in engagement with the one driving roll 11. It will be noted that jaw means 32, 33 are provided which engage opposite end portions of the core C about which web material W is being wound at the first position. During winding of a roll at the first winding position the jaw means 32, 33 are resiliently biased by corresponding cylinder devices 34, 35 for urging the roll of web material into engagement with the one driving roll 11 while accommodating the gradual enlargement of the diameter of the roll.

In accordance with this invention, the roll is transferred from the first winding position in engagement with the one driving roll 11, to a second winding position after the roll has been wound to a predetermined initial size. The present invention provides transfer arm means 38, 39 for this purpose, with the transfer arm means being operated by portions of a control means including a transfer shaft means 40. The transfer shaft means 40 is supported from the pair of spaced apart upstanding end frames and has a pair of crank arms 41, 42 affixed to the outboard ends thereof. Each of the crank arms 41, 42 is operatively connected to a corresponding pressure fluid actuated cylinder device 43, 44 for moving the crank arms, transfer shaft and transfer arms. The cylinder devices 43, 44 each have a cylinder and a piston extensible from the cylinder on admission of actuating pressure fluid to the cylinder, with one of the cylinder and piston being pivotally connected to the end frame of the apparatus 10 and the other of the cylinder and piston being pivotally connected to the corresponding crank arm 41, 42.

In accordance with an important feature of this invention, the transfer arms 38, 39 are movable along the transfer shaft 40 to positions spaced inwardly of the end frames of the apparatus 10. By such adjustable positioning of the transfer arms 38, 39, the arms are capable of being positioned closely adjacent the ends of a roll of web material being wound medially of the length of a core C at the first winding position. Thus, forces exerted on the core C on transfer of the roll from the first winding position to the second winding position are applied immediately adjacent the ends of the roll and flexure of the core C is minimized. Such flexure, with the resulting difficulties and deficiencies pointed out hereinabove, occurs where transfer forces are exerted at opposite terminal end portions of the core C as has been the case with previously proposed arrangements.

As will be understood, the manner of securing the arms 38, 39 to the shaft 40 is such as to accommodate ready adjustment of the arms one relative to the other while assuring secure fixation of the arms in adjusted position. It is contemplated that the specific form of such connection may take various configuration, such as a set screw, locking collar or key engaging or penetrating the shaft means 40.

Figure 6:
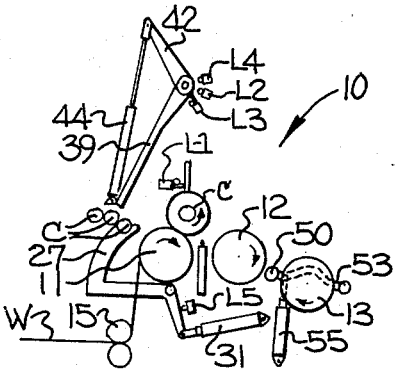
Figure 7:
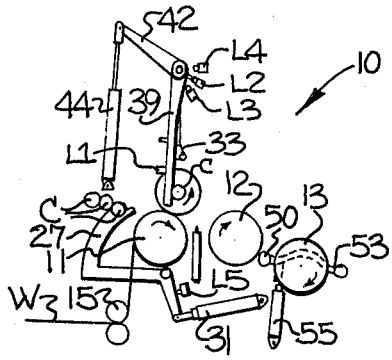
Figure 8:
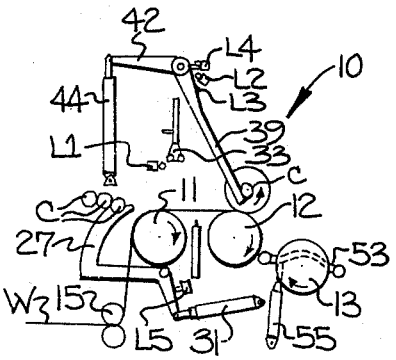
Figure 9:
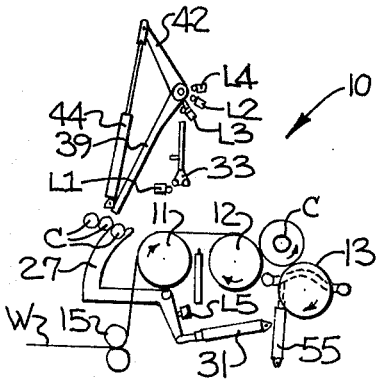

In accordance with other important features of the present invention, proper operation of both the core feeding means and the transfer arm means are obtained by the provision of control means operatively connected to both the core loading arms 26, 27 and the transfer arms 38, 39. The cylinder devices 30, 31, 43, 44 and associated devices to be described hereinafter form portions of that control means. In particular, a limit switch L1 or similar device is positioned to be responsive to movement of one of the jaw means 32, 33 indicative of the roll of web material being wound at the first winding position having reached a predetermined diameter suitable for transfer to the second position (FIG. 6). Upon closure of the limit switch L1, an electrical signal is applied to a solenoid operated valve S1 which admits actuating pressure fluid to the cylinder devices 43, 44 operatively connected with the crank arms 41, 42 and transfer shaft 40, initiating movement of the transfer arms 38, 39 toward the core C disposed at the first position. As the transfer arms 38, 39 approach the core C, (FIG. 7), one crank arm 42 closes a limit switch L2 which, by means of a solenoid actuated valve S2, retracts the jaw means 32, 33 so as to release the roll for transfer from the first winding position to the second winding position. Upon completion of the stroke of the transfer arms 34, 35 a limit switch L3 is engaged and opened, reversing the supply of actuating fluid to the cylinder devices 43, 44 and retracting the transfer arms 38, 39 from the transfer position (FIG. 8) to a withdrawn or retracted position (FIG. 9).

Figure 4:
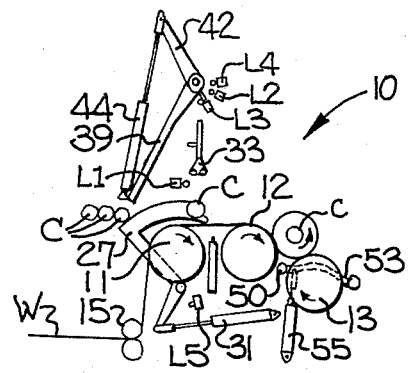
FIGS. 4 through 9 are schematic views generally similar to FIG. 1 illustrating a sequence of operational conditions of the apparatus of FIGS. 1 through 3 as operated in accordance with this invention.
Figure 5:
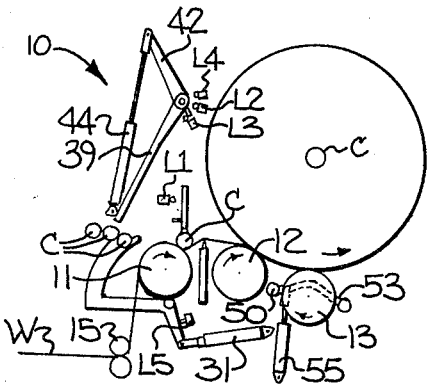

Retraction of the transfer arms 34, 35 subsequent to transfer of a roll closes a limit switch L4 and permits energization of a solenoid S3 controlling the admission of actuating pressure fluid to the load arm cylinder devices 30, 31. As a result, pressure fluid is admitted to the cylinder devices 30, 31 to pivot the core load arms 26, 27 and feed a new winding core C along a predetermined path of travel to the first position (FIG. 4). During such movement of a new core, a limit switch L5 is opened to preclude energization of the transfer arm solenoid S1. Thereafter, as the roll being wound in the second winding position reaches the desired full diameter, the web material is severed between the one driving roll 11 and one of the other driving rolls 12, lapped about the winding core in the first winding position to initiate formation of a new roll, and the fully wound roll is transferred through the operation of a lifting bar 50 and associated lifting arms 52, 53 and cylinder devices 54, 55, all as described in the previously granted patents identified hereinabove. It is to be recognized that the control means here described has been somewhat simplified in order to reduce unneeded repetition of description given elsewhere and to highlight the contribution made by this invention.

In the drawings and specification, there has been set forth a preferred embodiment of the invention, and although specific terms are employed, they are used in a generic and descriptive sense only and not for purposes of limitation.

That which is claimed is:

1. A winding apparatus comprising a pair of spaced apart upstanding end frames, a plurality of elongate driving rolls extending between said end frames and mounted for rotation about parallel spaced apart axes for supporting a roll of web material wound about a core at a first winding position and in engagement with one of said driving rolls during winding to a predetermined initial size and for supporting the roll of web material at a second winding position and in engagement with the other of said driving rolls during continuation of winding to a final size, means for engaging winding cores closely adjacent opposite ends thereof and for feeding engaged winding cores along a predetermined path of travel to the first winding position for winding of successive rolls of web material, means for transferring a roll of web material wound about a core from the first winding position to the second winding position including a pair of movable transfer arm means for engaging the winding core of the roll of web material at locations spaced inwardly from opposite ends thereof and on opposite sides of the roll of web material when the roll is in the first winding position and for displacing the roll to the second winding position, said pair of transfer arm means being movable along a path intersecting said path of travel of winding cores being fed to the first winding position, and control means operatively connecting said core feeding means and said pair of transfer arm means for moving the same in sequential timed relation.

2. Apparatus according to claim 1 wherein said pair of transfer arm means are adjustably movable toward each other inwardly of said end frames for engaging the winding core closely adjacent the ends of a roll of web material wound thereon irrespective of the width of the web material relative to the length of the core for thereby avoiding flexure of the winding core of the roll of web material when the same is transferred from the first winding position to the second winding position.

3. Apparatus according to claim 1 further comprising movable jaw means mounted adjacent the first winding position for movement into engagement with opposite ends of a winding core disposed in the first winding position and for biasing a roll of web material being wound about the winding core into engagement with said first driving roll, said movable jaw means also being movable away from said one driving roll as the engaged winding core is moved away from said one driving roll by the diameter of the roll increasing, and further wherein said control means comprises means responsive to movement of said movable jaw means away from said one driving roll by the diameter of the roll increasing, for initiating transfer of the roll of web material from the first winding position to the second winding position upon the roll of web material reaching a predetermined diameter.

4. Apparatus according to claim 3 wherein said control means further comprises means responsive to movement of said pair of transfer arm means into position for engaging the winding core of the roll to be transferred and operatively connected with said jaw means for moving said jaw means out of engagement with the winding core.

5. A winding apparatus comprising a pair of spaced apart upstanding end frames, a plurality of elongate driving rolls extending between said end frames and mounted for rotation about parallel spaced apart axes for supporting a roll of web material wound about a core at a first winding position and in engagement with one of said driving rolls during winding to a predetermined initial size and for supporting the roll of web material at a second winding position and in engagement with the other of said driving rolls during continuation of winding to a final size, magazine means for receiving and retaining a plurality of winding cores, means for engaging winding cores closely adjacent opposite ends thereof and for sequentially feeding winding cores along a predetermined path of travel from said magazine means to first winding position for winding of successive rolls of web material, means for transferring a roll of web material wound about a core from the first winding position to the second winding position including a pair of movable transfer arm means for engaging the winding core of the roll of web material at locations spaced inwardly from opposite ends thereof and on opposite sides of roll of web material when the roll is in the first winding position and for displacing the roll to the second winding position, said pair of transfer arm means being movable along a path intersecting said path of travel of winding cores being fed to the first winding position, and control means operatively connecting said core feeding means and said pair of transfer arm means for moving the same in sequential timed relation and thereby avoiding interference therebetween.

6. Apparatus according to claim 5 further comprising means for guiding web material along a predetermined path of travel to the first winding position and further wherein said path of travel of winding cores being fed to the first winding position and said path of movement of said pair of transfer arm means are positioned adjacent to the upper surface of the web material being guided to the first winding position.

7. Apparatus according to claim 5 wherein said control means comprises transfer motive means operatively connected to said pair of transfer arm means for moving the same between a withdrawn position spaced from said first winding position and a transfer position engaging the winding core of the roll of web material being displaced to said second winding position, core feed motive means operatively connected to said core feeding means for moving the same between a receiving position adjacent said magazine means and a delivery position adjacent said first winding position, and means operatively connected to said transfer motive means for sensing return movement of said pair of transfer arm means from said transfer position to said withdrawn position and operatively connected to said core feed motive means for initiating movement of said core feeding means to said delivery position in response to the sensed return of said pair of transfer arm means to said withdrawn position.

8. Apparatus according to claim 7 wherein said transfer motive means operatively connected to said pair of transfer arm means comprises transfer shaft means supporting said pair of transfer arm means and extending between said end frames and mounted for movement about an axis parallel to and spaced from said driving rolls, crank arm means operatively connected to said transfer shaft means for transmitting motion thereto, and expansible chamber pressure fluid actuator means operatively connected to said crank arm means for moving the same.

9. Winding apparatus comprising a pair of spaced apart upstanding end frames, means for receiving elongate winding cores which extend substantially from one of said end frames to the other and for supporting a core in a first winding position for winding a roll of web material to a predetermined initial size, the web material optionally being of full width so that only short opposite end portions of the core extend beyond the roll or of considerably lesser width so that substantial opposite end portions of the core extend beyond the roll, means for receiving the initial size roll of web material from the first winding position and for supporting the roll in a second winding position during continuation of winding to a final size, and a pair of transfer arm means adjustably movable inwardly of said end frames for being positioned closely adjacent opposite ends of the initial size roll of web material for engaging the opposite end portions of the winding core at locations spaced inwardly from opposite ends thereof and transferring the same from the first winding position to the second winding position whereby transfer of various width rolls may be smoothly effected without encountering flexure and rupture of winding cores.

* * * * *

UNITED STATES PATENT OFFICE

CERTIFICATE OF CORRECTION

PATENT NO. : 3,972,486

DATED : August 3, 1976

INVENTOR(S) : John E. Straujups

It is certified that error appears in the above-identified patent and that said Letters Patent are hereby corrected as shown below:

Column 6, Line 42 after "to" insert -- the --;
Column 6, Line 49 after "of" insert -- the --.

Signed and Sealed this

Sixteenth Day of November 1976

[SEAL]

*Attest:*

RUTH C. MASON
*Attesting Officer*

C. MARSHALL DANN
*Commissioner of Patents and Trademarks*